US006454105B1

(12) United States Patent
Medina

(10) Patent No.: US 6,454,105 B1
(45) Date of Patent: Sep. 24, 2002

(54) BALL BRACKET

(76) Inventor: David Larry Medina, 655 Taft, San Antonio, TX (US) 78225

( * ) Notice: Subject to any disclaimer, the term of this patent is extended or adjusted under 35 U.S.C. 154(b) by 0 days.

(21) Appl. No.: 09/565,870

(22) Filed: May 5, 2000

(51) Int. Cl.[7] ..... A47F 7/00
(52) U.S. Cl. ..... 211/14; 211/85.7; D6/552
(58) Field of Search ..... 211/14, 85.7, 106; 248/309.1; 206/315.9, 315.91; D6/552

(56) References Cited

U.S. PATENT DOCUMENTS

| | | | | | |
|---|---|---|---|---|---|
| 533,847 | A | | 2/1895 | Hilton | |
| 1,024,536 | A | * | 4/1912 | Taylor | |
| 1,294,916 | A | | 2/1919 | Knight | |
| 2,508,841 | A | | 5/1950 | Schreibman | 248/30 |
| D240,059 | S | * | 5/1976 | Lewis | |
| D242,402 | S | * | 11/1976 | Bratene et al. | |
| 4,684,096 | A | | 8/1987 | Tanaka | 248/309.1 |
| 5,004,137 | A | * | 4/1991 | Wu | 206/315.9 X |
| D330,061 | S | * | 10/1992 | Hilbert | |
| 5,203,462 | A | | 4/1993 | Brooks | 211/14 |
| 5,232,101 | A | * | 8/1993 | Shaftner et al. | 211/14 |
| 5,335,794 | A | | 8/1994 | Reedy | 211/85.7 |
| D363,520 | S | * | 10/1995 | Melillo | |
| 5,673,800 | A | | 10/1997 | Connolly | 211/41.7 |
| 5,813,550 | A | | 9/1998 | Sheehan et al. | 211/87.01 |
| 5,823,360 | A | * | 10/1998 | Gonosave | 211/14 X |
| 5,855,286 | A | * | 1/1999 | Zaid | 211/85.7 |
| 6,029,826 | A | * | 2/2000 | Clay | 211/14 |

* cited by examiner

*Primary Examiner*—Robert W. Gibson, Jr.
(74) *Attorney, Agent, or Firm*—Cox & Smith Incorporated

(57) ABSTRACT

A ball bracket for holding basketballs, footballs, and the like. The ball bracket includes three arcuate members and a means for securing the ball bracket to a supporting structure. Two of the arcuate members are coplanar forming a semicircle. The third arcuate member perpendicularly intersects the semicircle formed by the first two arcuate members at its mid point. The means for securing the ball bracket to the supporting structure is comprised of a rigid plate which lies in a plane tangent to the mid point of the semicircle formed by the first two arcuate members. The semicircle and the third arcuate member are all rigidly attached and arc away from the plate. The present invention additionally provides a ball bracket which includes at least two arcuate members independent of one another and a means for securing the ball bracket to a supporting structure. All arcuate members terminate at a common point on and arc away from the means for securing the ball bracket to a supporting structure.

19 Claims, 4 Drawing Sheets

BALL BRACKET

BACKGROUND OF THE INVENTION

1. Field of the Invention

The present invention generally relates to sports equipment storage devices, more specifically to a ball bracket mounted to a supporting structure wherein arcuate members partially encompass and hold a ball.

2. Background Information

Storing basketballs, footballs, and the like at home or at school is often problematic. Placing a ball securely on a shelf or other storage location is virtually impossible; the ball invariably rolls onto the floor. Having a basketball, football, or the like lying loosely on the floor is a hazard and further adds to the clutter of most children's rooms or school storage supply rooms.

At school, a cart or basket is often used to transport and store sports related balls. The basket or cart is then stored in a supply room. While these holding devices help avoid hazards, storage often takes up much needed valuable space for the storage of other types of sports equipment. At home, a closet is often used to store basketballs or footballs. Consequently, the contents of the closet become a hazard as the basketball, football, and other contents spill out of the closet when the door is opened. Likewise, stepping into the closet becomes difficult. An elevated device for securely storing sports balls, whether at home or at school, would serve to prevent tripping or related accidents as well as provide a more organized and efficient manner of storage.

In an effort to address the need for a more efficient storage of balls, particularly sports related balls, a number of equipment racks have been developed. These devices focus on support devices wherein the sports equipment is placed on the rack. The device is then dependent on gravity to keep the balls or other equipment in place. If the ball or device is bumped, the ball easily falls off. In sum, these devices do not provide a secure holding device for a ball.

U.S. Pat. No. 5,203,462 describes a sports equipment rack having a ball holder and a balancing leg extending outwardly from each of the ends of the ball holding region and a means for securing the, ball holder to the wall. The radius of curvature as a ball holding region is less than the radius of the ball to be supported. While the device provides for the support of sports related balls and other sports equipment, it does not provide a secure manner of holding the equipment.

Likewise, U.S. Pat. No. 5,335,794 describes a sports equipment support rack. The invention includes both a fixed frame and a removable basket which provide support for equipment of a variety of sports. The fixed frame includes bat retainers for supporting a plurality of bats and parallel guide members for removably supporting balls such as basketballs, soccer balls, etc. The device, however, is cumbersome and uses much unnecessary space.

U.S. Pat. No. 5,813,550 teaches a storage rack with threaded pegs. It includes a compact base with two or more pairs of peg holes and two or more pegs that may be inserted into any selected pair of holes. While this invention provides a means for storing various items, it does not address the need for storing basketballs, footballs, and the like.

The ball bracket of the present invention has specific design features which distinguishes it from the prior art devices. These features allow for use of the ball bracket without the need for relying on gravity to keep the balls in place. Further, the device is convenient, simple, and inexpensive.

SUMMARY OF THE INVENTION

The present invention provides a ball bracket for holding basketballs, footballs, and the like. The ball bracket includes three arcuate members and a means for securing the ball bracket to a supporting structure. Two of the arcuate members are coplanar forming a semicircle. The third arcuate member perpendicularly intersects the semicircle formed by the first two arcuate members at its mid point. The means for securing the ball bracket to the supporting structure is comprised of a rigid plate which lies in a plane tangent to the mid point of the semicircle formed by the first two arcuate members. The semicircle and the third arcuate member are all rigidly attached and arc away from the plate.

The present invention additionally provides a ball bracket which includes at least two arcuate members independent of one another and a means for securing the ball bracket to a supporting structure. All arcuate members terminate at a common point on and arc away from the means for securing the ball bracket to a supporting structure.

It is an object of the present invention to provide a ball bracket which partially encompasses and holds a ball.

It is a further object of the present invention to provide a ball bracket which is inconspicuous when in use.

It is a further object of the present invention to provide a ball bracket which does not rely on gravity to hold a ball in place.

It is a further object of the present invention to provide a ball bracket which maintains the position of the ball even if the ball is bumped or the ball bracket itself if jostled.

It is a further object of the present invention to provide a ball bracket which is convenient, simple, and inexpensive.

The present invention partially encompasses and serves to hold a ball without the help of gravity. The device is simple, inexpensive, and is easily situated for use.

DETAILED DESCRIPTION OF THE PREFERRED EMBODIMENT

The ball bracket of the present invention will now be described in detail by reference to specific figures; however, this detailed description should not be interpreted as limiting the principles of the invention.

Figure 1:
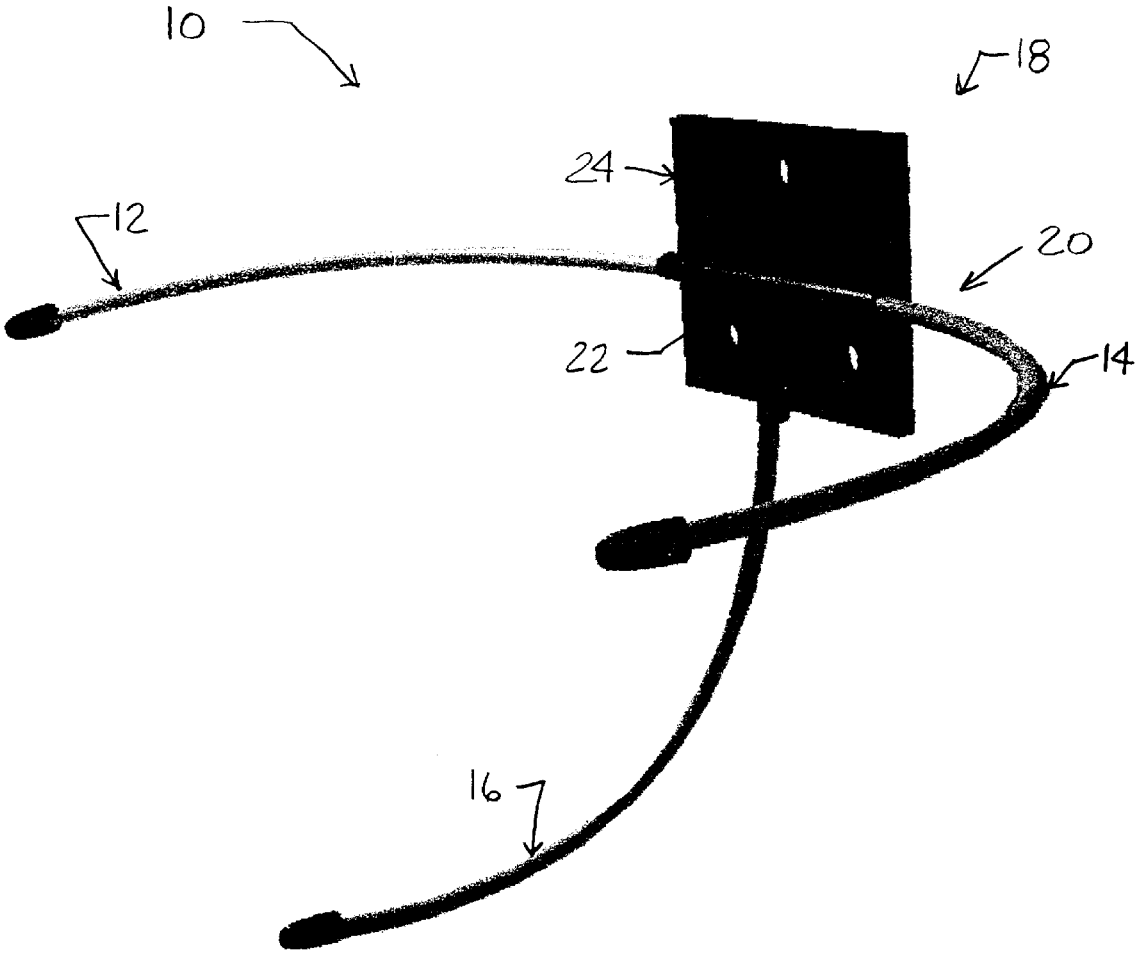
FIG. 1 is a perspective view of the preferred embodiment of the present invention.

FIG. 1 provides a perspective view of the preferred embodiment of the present invention. The ball bracket (10) includes three arcuate members (12, 14, 16), and a means for fixedly securing the ball bracket to a supporting structure (18). In the present invention the arcuate members (12, 14, 16) partially encompass and hold a ball. As seen in FIG. 1, two of the arcuate members (12, 14) are coplanar forming a semicircle(20). The third arcuate member (16) perpendicularly intersects the semicircle (20) formed by the coplanar members midpoint(22).

Referring again to FIG. 1, the means for fixedly securing the ball bracket to a supporting structure (18) includes a rigid plate (24) which lies in a plane tangent to the midpoint (22) of the semicircle (20) formed by the coplanar arcuate members (12, 14). The semicircle (20) is rigidly attached to the plate (24) and arcs away from the plate (24). The third arcuate member (16) lies in a plane ninety degrees to the semicircle (20) and also arcs away from the plate (24). The plate (24) can then be secured to a supporting structure (18) in a fixed manner such as with a screw. In FIG. 1, the two semicircular arcuate members (12, 14) are formed of a single piece of material with the third arcuate member (16) perpendicularly intersecting the semicircle (20) at its midpoint (22).

Figure 2:
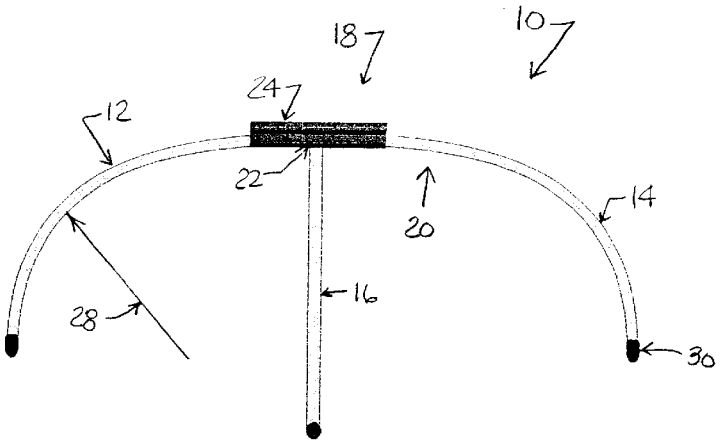
FIG. 2 is a top view of the preferred embodiment of the present invention.

FIG. 2 shows a top view of the preferred embodiment of the present invention. Once again, the ball bracket (10) is shown having three arcuate members (12, 14, 16) and a means for securing the ball bracket to a supporting structure (18). Two of the arcuate members (12, 14) are coplanar forming a semicircle (20) and the third arcuate member (16) perpendicularly intersects the semicircle (20) formed by the coplaner members (12, 14) at its mid-point (22). The coplanar arcuate members (12, 14) forming a semicircle (20) are constructed of a single piece of material. In Applicant's preferred embodiment the radius of curvature of the arc (28) formed by each of the coplaner arcuate members (12, 14) is seven inches.

FIG. 2, the means for fixedly securing the ball bracket to a supporting structure (18) is shown as a rigid plate (24) which lies in a plane tangent to the mid-point (22) of the semicircle (20) formed by the coplaner arcuate members (12, 14). Again, the plate (24) can then be secured to a supporting structure (18) in a fixed manner such as with a screw. The coplaner arcuate members (12, 14) are rigidly attached to the plate (24) and arc away from it. The third arcuate member (16), lying in a plane 90° to the semicircle (20), also arcs away from the plate (24). The third arcuate member (16), again perpendicularly intersects the semicircle (20) at its mid-point (22).

At the end of each arcuate member (12, 14, 16) is a plastic tip cover (30) which protects against injury, protects the integrity of the ball placed in the ball bracket, and helps secure the ball within the ball bracket. When used, the arcuate members (12, 14, 16) partially encompass and hold the ball. The length of the arc (28) in Applicant's preferred embodiment enables Applicant's invention to securely hold a ball but allows the invention to remain inconspicuous. When used, Applicant's invention is hidden from view from an individual standing in front of Applicant's invention; the ball appears suspended in mid-air.

Further, Applicant's device does not rely on gravity. It does not simply support a ball placed on top of the device, but securely encompasses and holds the ball. Consequently, the ball remains in place even if it is bumped or jostled.

Figure 3:
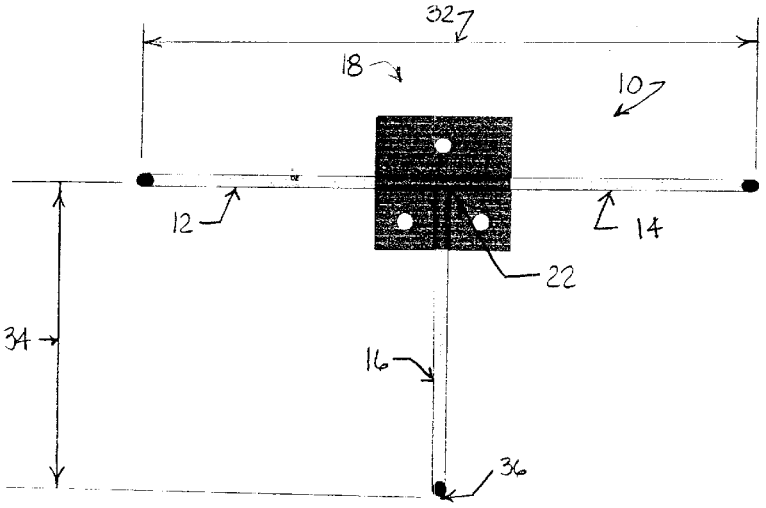
FIG. 3 is a front view of the preferred embodiment of the present invention.

Turning now to FIG. 3, the preferred embodiment of the present invention is shown in front view. Once again, the ball bracket (10) includes three arcuate members (12, 14, 16) and a means for securing the ball bracket to a supporting structure (18). FIG. 3 clearly illustrates the coplaner arcuate members (12, 14). As seen, the third arcuate member (16) lies in a plane 90° to the semicircle (not visible in FIG. 3) formed by the coplanar members (12, 14). As shown in FIG. 3, the means for securing the ball bracket to a supporting structure (18) is a rigid plate (24) which lies in a plane behind the arcuate members (12, 14, 16) tangent to the mid-point (22) of the semicircle (not visible in FIG. 3) formed by the coplanar arcuate members (12, 14). In Applicant's preferred embodiment, the length of the coplaner arcuate members (32) shown in front view is 9.25: inches. Likewise, the length of the third arcuate member (34) as shown in front view from its tip (36) to its intersection with the coplanar arcuate members (22) is 4.75 inches.

Figure 4:
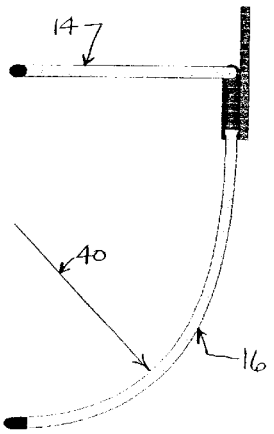
FIG. 4 is a side view of the preferred embodiment of the present invention.

FIG. 4 is a side view of the preferred embodiment of the present invention. The third arcuate member (16) which perpendicularly intersects the semicircle (not visible in FIG. 4) formed by the coplaner members (12, 14) is clearly visible. One of the two coplaner arcuate members (14) is visible while the second coplaner arcuate member (12) is hidden from view. In Applicant's preferred embodiment, the radius of curvature of the arc (40) formed by the third arcuate member (16) is seven inches.

Figure 5:
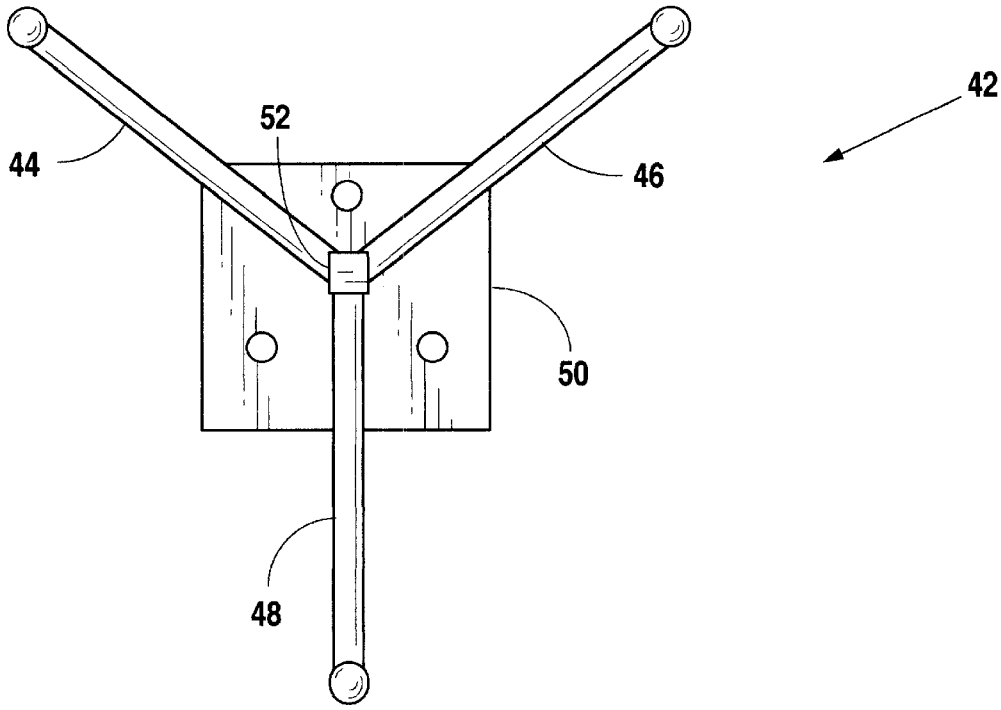
FIG. 5 is a front view of the present invention having arcuate members independent of one another.

Referring to FIG. 5, the front view of the present invention is shown including arcuate members independent of one another. The ball bracket (42) includes three arcuate members (44, 46, 48) and a rigid plate (50) which secures the ball bracket (42) to a supporting structure. While the arcuate members (44, 46, 48) terminate at a common point (52) on the rigid plate (50), none of the arcuate members (44, 46, 48) are coplaner. As with the preferred embodiment of Applicant's invention shown in FIGS. 1–4, the arcuate members (44, 46, 48) arc away from the rigid plate (50). In FIG. 5, the arcuate members (44, 46, 48) are no less than 90° from one another. The rigid plate (50) lies in a plane tangent to the arcuate members (44, 46, 48) common point (52) of termination. This illustration, however, is not limiting. Although not shown in FIG. 5, it is possible for two of the three arcuate members in FIG. 5 to be positioned at less than 90° from one another.

Figure 6:
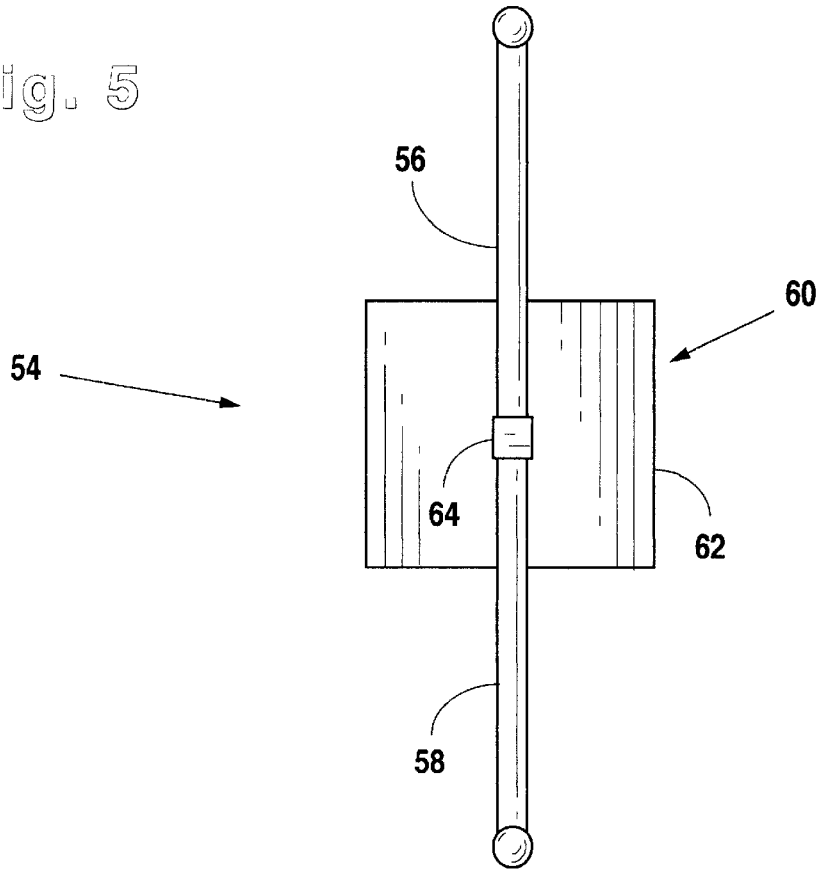
FIG. 6 is a front view of the present invention having two arcuate members.

FIG. 6 is the front view of the present invention having two arcuate members. Consequently, the ball bracket (54) includes two arcuate members (56, 58) and a means for fixedly securing the ball bracket (54) to a supporting device (60). The means for securing the ball bracket (54) to a supporting device (60) as shown in FIG. 6 is a rigid plate (62). While the arcuate members (56, 58) shown in FIG. 6 are coplaner, the positioning.

The arcuate members shown in FIG. 6 may be formed of a single piece of material or may be independent of one another.

Figure 7:
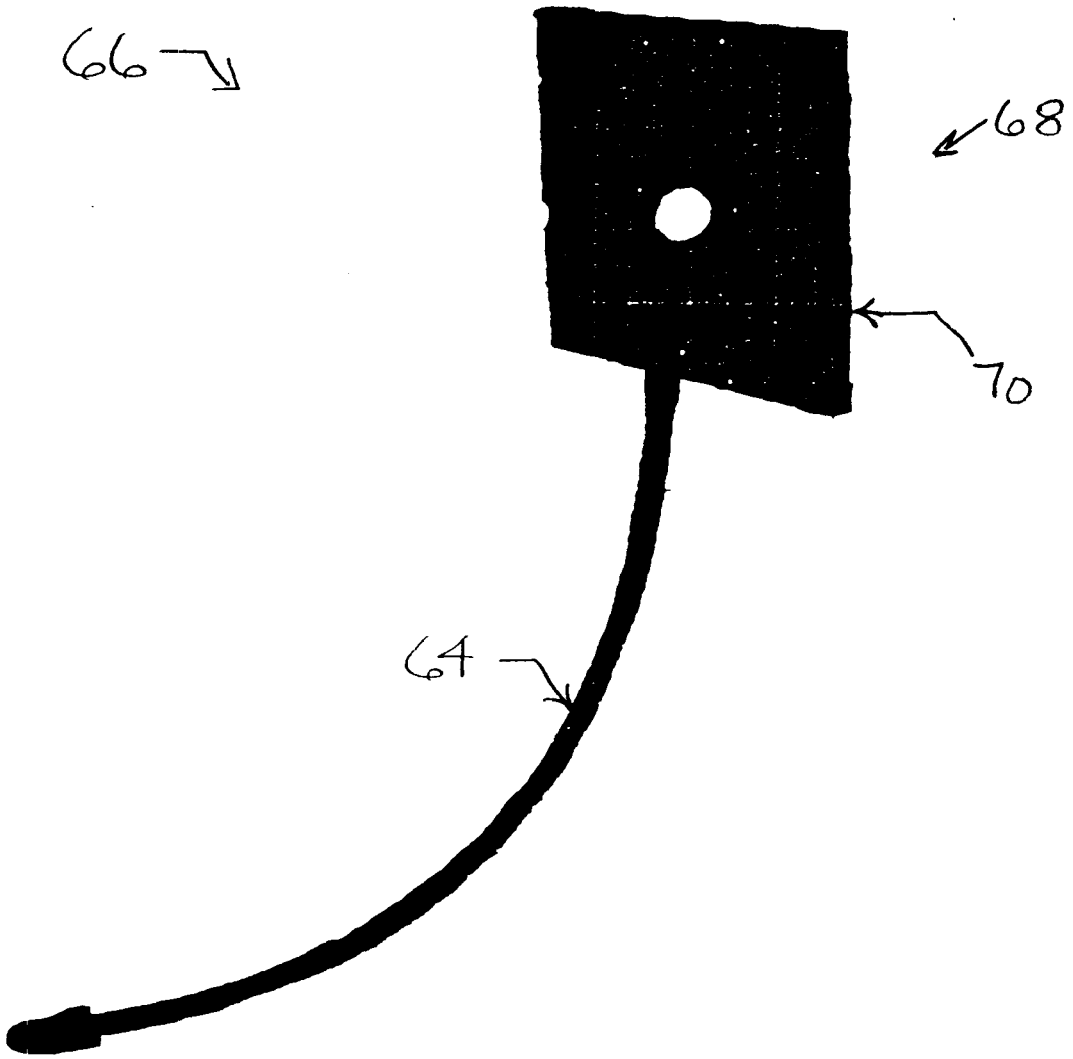
FIG. 7 is a perspective view of the present invention having one arcuate member.

Lastly, FIG. 7 illustrates how the present invention can also be modified to include one arcuate member (64) and a means for securing the ball bracket (66) to a supporting structure (68). Once again, the means for securing the ball bracket (66) is comprised of a rigid plate (70) with the arcuate member (64) arcing away from the plate (70).

While FIGS. 1–5 illustrate a ball bracket more suitable to accommodate basketballs, soccer balls and the like, they may also accommodate a football. The alternative embodiment illustrated in FIG. 6, however, better accommodates a football but may also accommodate basketballs, soccer balls and the like. The alternative embodiment comprised of a single arcuate member (not shown in FIGS. 1–6) is suitable to accommodate basketballs, soccer balls, and footballs.

Although Applicant has described his invention in detail with regard to the preferred embodiment, the disclosure is not intended to limit the invention, but rather, it is intended to cover such alternatives, modifications and equivalents that may be included in the spirit and scope of the invention as such alternatives. modifications and equivalents that may be included in the spirit and scope of the invention as herein disclosed.

I claim:

1. A ball bracket comprising:

(a) three arcuate members wherein two of said arcuate members are coplanar, said coplanar arcuate members forming a semi-circle, wherein said third arcuate member perpendicularly intersects said semi-circle at its mid-point and wherein said arcuate members partially encompass and hold a ball; and (b) a means for fixedly securing said ball bracket to a supporting structure wherein said means for securing said ball bracket is comprised of a rigid plate which lies in a plane tangent to the mid-point of said semi-circle.

2. The ball bracket of claim 1 wherein said semicircle is rigidly attached to said plate, said semicircle arcing away from said plate.

3. The ball bracket of claim 2 wherein said third arcuate member lies in a plane ninety degrees to said semicircle, said third arcuate member arcing away from said plate.

4. A ball bracket comprising:

(a) three arcuate members, wherein two arcuate members are coplanar and are formed of a single piece of material, said coplanar arcuate members forming a semi-circle, wherein said third arcuate member perpendicularly intersects said semi-circle at its mid-point and wherein said arcuate members partially encompass and hold a ball; and (b) a means for fixedly securing said ball bracket to a supporting structure, wherein said means for securing said ball bracket is comprised of a rigid plate which lies in a plane tangent to the mid-point of said semi-circle.

5. The ball bracket of claim 4 wherein said semicircle is rigidly attached to said plate, said semicircle arcing away from said plate.

6. The ball bracket of claim 5 wherein said third arcuate member lies in a plane ninety degrees to said semicircle, said third arcuate member arcing away from said plate.

7. A ball bracket comprising:

(a) three arcuate members wherein said arcuate members partially encompass and hold a ball and wherein said arcuate members are independent of one another; and (b) a means for fixedly securing said ball bracket to its supporting structure.

8. The ball bracket of claim 7 wherein said means for securing said ball bracket is comprised of a rigid plate.

9. A ball bracket comprising:

(a) three arcuate members, said three arcuate members independent of one another; and (b) a means for securing said ball bracket to a supporting structure, said means for securing said ball bracket comprised of a rigid plate;

wherein said arcuate members partially encompass and hold a ball; and wherein said arcuate members terminate at a common point on said rigid plate.

10. The ball bracket of claim 9, wherein said arcuate members arc away from said rigid plate.

11. The ball bracket of claim 10 wherein said arcuate members are no less than 90 degrees from one another.

12. A ball bracket comprising:

(a) two arcuate arm members wherein said arcuate arm members are coplanar forming a semicircle;

(b) one arcuate leg member perpendicularly intersecting said semicircle at its midpoint, said arcuate leg member lying in a plane ninety degrees from said semicircle wherein said arcuate arm members and said arcuate leg member partially encompass and serve to hold a ball, and;

(c) a rigid plate for fixedly securing said ball bracket to a supporting structure wherein said rigid plate lies in a plane tangent to said midpoint of said semicircle, said arcuate arm members and said arcuate leg member are rigidly attached to said plate, and said arcuate arm members and said arcuate leg member arc away from said plate.

13. A ball bracket comprising:

(a) at least two arcuate members, said arcuate members independent of one another; and (b) a means for securing said ball bracket to a supporting structure, said means for securing said ball bracket comprised of a rigid plate;

wherein said arcuate members partially encompass and hold a ball and wherein said arcuate members terminate at a common point on said rigid plate.

14. The ball bracket of claim 13 wherein said arcuate members arc away from said rigid plate.

15. The ball bracket of claim 14 wherein said arcuate members are no less than 90 degrees from one another.

16. The ball bracket of claim 13 wherein two of said arcuate members are coplanar.

17. The ball bracket of claim 16 wherein said means for securing said ball bracket is comprised of a rigid plate.

18. The ball bracket of claim 17 wherein said arcuate members terminate at a common point on said rigid plate.

19. The ball bracket of claim 18 wherein said arcuate members arc away from said rigid plate.

* * * * *